United States Patent [19]

Olson et al.

[11] Patent Number: 4,559,889

[45] Date of Patent: Dec. 24, 1985

[54] OUTBOARD MOTOR STEERING CONTROL SYSTEM

[76] Inventors: Harlan W. Olson, Box 132; Patrick L. Hall, both of Barrett, Minn. 56311

[21] Appl. No.: 624,776

[22] Filed: Jun. 26, 1984

[51] Int. Cl.[4] ..... B63H 25/00

[52] U.S. Cl. ..... 114/153; 440/63

[58] Field of Search ..... 114/153, 144 R, 128, 114/146; 440/7, 63

[56] References Cited

U.S. PATENT DOCUMENTS

| | | | |
|---|---|---|---|
| 2,968,273 | 1/1961 | Corbett | 114/153 |
| 3,288,099 | 11/1966 | Bittner | 114/153 |
| 3,420,203 | 1/1969 | Ambrosh | 114/153 |

*Primary Examiner*—Trygve M. Blix
*Assistant Examiner*—C. T. Bartz
*Attorney, Agent, or Firm*—Hugh D. Jaeger

[57] ABSTRACT

Outboard motor steering control system including a mounting bracket, torsion bar axially supported on a U-shaped bracket, foot pedal secured to the torsion bar, and a linkage rod connecting between a pedal bar on the foot pedal to a U-shaped bracket on a motor, whereby the two-bar linkage provides for control of steering of the outboard motor during trolling. The mounting bracket secures to the splash tray of the boat, while the foot pedal includes a heel plate for accommodating an entire foot and the heel in a comfortable manner. Ball joints are provided between the nut and bolt assemblies securing onto the U-shape bracket of the motor and the pedal bar for the two-bar linkage. The outboard motor control steering system is intended for use with low horse power outboards operating at low speeds. The system is particularly intended for use by fishermen during trolling or fishing operations.

1 Claim, 3 Drawing Figures

OUTBOARD MOTOR STEERING CONTROL SYSTEM

BACKGROUND OF THE INVENTION

1. Field of the Invention

The present invention pertains to outboard motors, and more particularly, pertains to outboard motor steering control systems for foot control of an outboard motor during trolling.

2. Description of the Prior Art

The prior art devices for controlling motors have usually been complex, bulky, and mechanical devises which are clumsy in operation, mechanically complex yielding a certain factor of risk to life and operation, and do not provide for total direct control of steering of the motor during trolling or fishing.

It is well recognized that most fishermen are right handed and usually sit in the boat to steer with the left hand, while using a fishing reel in the right hand. Therefore, the fisherman would be prone to steer with the left foot, while the right foot provides the necessary body support through the bracing of the right foot in the boat. Therefore, there has always been a void in the prior art for a left foot control which provides control of the motor and also the necessary body support with respect to the left foot acting against the structural member of the boat.

Typical prior art mechanical devices for controlling steering of an outboard motor are disclosed in U.S. Pat. Nos. 2,749,872; 2,968,273; and 3,288,099. All of these patents represent prior art devices which are complex mechanical structures and do not provide the motor steering control as disclosed in this patent; and also do not provide the necessary body support for the left leg of an individual with respect to steering of the motor while at the same time supporting the left leg.

The present invention overcomes the disadvantages of the prior art by providing an outboard motor steering system which includes a two-bar linkage, support of the left foot of a fisherman, while at the same time providing for steering of the motor by the left foot of the fisherman, or in the alternative, support of the right foot of a fisherman while at the same time providing for steering of the motor by the right foot of the fisherman. The system is adaptable to any rowboat, but particularly lends itself to the popular version of fishing boat with the splash tray as now sold worldwide.

SUMMARY OF THE INVENTION

The general purpose of the present invention is to provide an outboard motor steering control system for control by an individual's leg, where the system can be connected for control by either the left foot, or in the alternative, the right foot. The system is particularly intended for use by fishermen during a trolling or fishing operation for steering an outboard motor, such as a commonly used 7.5 or 8 horse power Mariner or Mercury engines. The system is also applicable to Evinrude and Johnson engines, as well as any other type of outboard or electric engines.

According to one embodiment of the present invention, there is provided an outboard motor steering control system including a foot pedal; a heel plate attached to one end of the foot pedal; a pedal bar mounting plate, including a pedal bar attached thereto at the upper end of the foot pedal; a torsion rod secured to the mid portion of the foot pedal and is rotateably supported in a bracket; a linkage rod including ball joints at either end connected between the top portion of the pedal bar; and a U-shaped bracket of the outboard motor whereby the two-bar linkage of the linkage rod and pedal bar transfers movement from the rotation of the foot pedal to the U-shaped bracket of the motor, which provides for rotation of the motor about the vertical pivot pin to the motor.

One significant aspect and feature of the present invention is an outboard motor steering control system which operates through a two-bar linkage providing direct and absolute control of the steering of the motor during trolling. There is a least number of moving components, those components which do move being either a ball joint at either end of the linkage rod, or the torsion rod axially rotating within a bracket. The least number of mechanical components insures integrity of the system, while assuring control of the motor.

Another significant aspect and feature of the present invention is an outboard motor steering control system which can be installed by an average individual, such as a fisherman, with a minimum number of tools including a drill and a wrench or socket wrench assembly. No fancy tools are required and installation time is at an absolute minimum, usually no more than 10 to 15 minutes.

A further significant aspect and feature of the present invention is a motor steering control system which is made out of heavy duty parts providing that the system will not break-down and subject the users to injury on the water. The components can be made out of heavy gage steel and rod commonly available, and the foot pedal is heavy gage steel including the heel plate providing for a secure mechanical and structural feeling to the operator providing muscular sensory feedback during operation.

Having thus described the embodiments of the present invention, it is the principal object hereof to provide an outboard motor steering control system for use in a fishing boat and for use with an outboard motor, such as motors commonly used for trolling.

One object of the present invention is to provide an outboard motor steering control system which is utilized by the common fisherman, such as that fisherman who is right handed, meaning that the left foot is free to control a motor, while the right foot provides necessary support while sitting in a row boat with a low horse power motor utilized for trolling. This particular bracket has been utilized in the ever-popular fishing configuration of a Lund fishing boat with a 7 or 8 horse power motor, such as that made by Mariner or Mercury. Of course, the system can be utilized in any other style of row boat and with any other type of outboard motor.

Another object of the present invention is to provide an outboard motor steering control system which provides for total free and unencumbered use of the outboard motor while not having to disconnect the system during use of only the outboard motor. Of course, if one desires to disconnect the system, it only takes a wrench to remove a nut off a threaded rod, dropping the linkage rod and disconnecting the rod from the motor.

DESCRIPTION OF THE PREFERRED EMBODIMENTS

Figure 1:
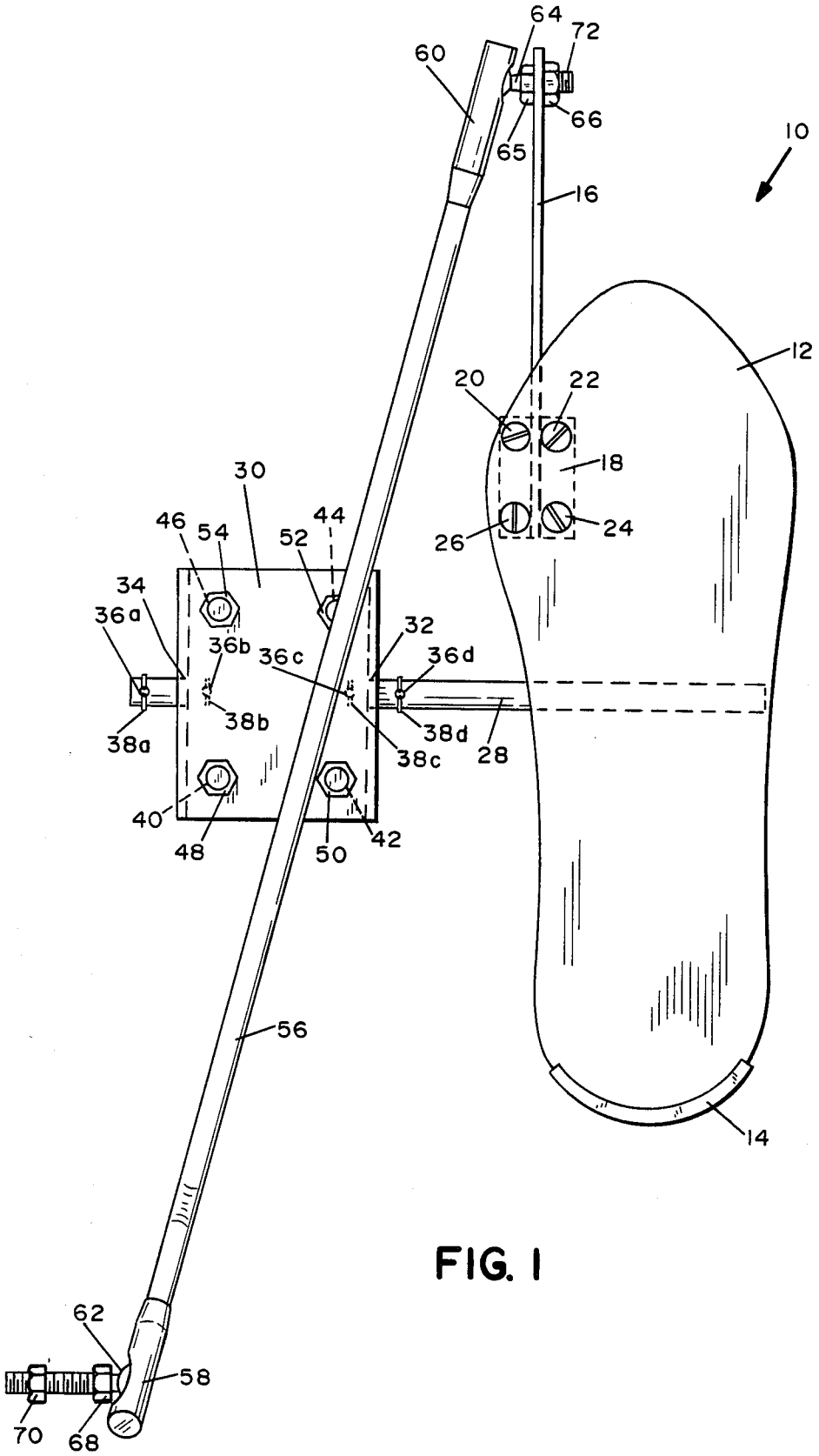
FIG. 1 illustrates a top view of an outboard motor control system.
Figure 2:
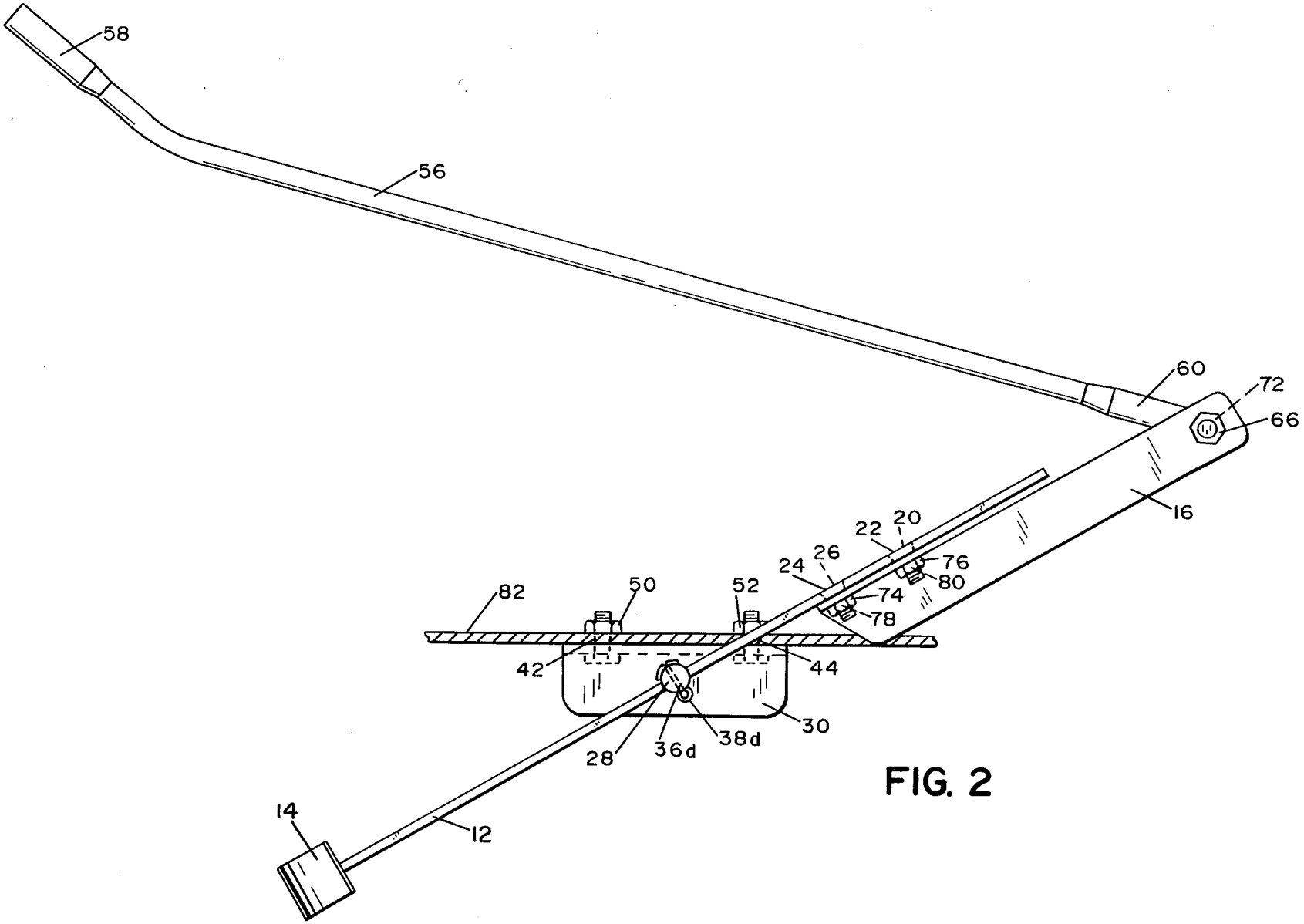
FIG. 2 illustrates a side view of FIG. 1.

FIG. 1 illustrates a top view of an outboard motor steering control system 10, including a foot pedal 12 configured to the shape of a left foot; a heel plate 14 affixed at the bottom of the foot pedal 12, such as by welding or the like; and, a pedal bar 16 affixed by way of a bracket of a pedal bar mounting plate 18 secured thereto to foot pedal 12 with flat head machine screws of the like 20, 22, 24, and 26 and nuts 74, 76, 78, and 80 with lockwashers as illustrated in FIG. 2. A torsion rod 28 secures to a mid point of the foot pedal 12, such as by welding and is mounted within a mounting bracket 30, which is U-shaped as now described in detail. The mounting bracket includes torsion rod holes 32 and 34 of opposite sides of the U-shaped bracket; holes 36*a*–36*d* for cotter pins and cotter pin keys 38*a*–38*d* for encompassing the torsion rod about the bracket 30; and a plurality of mounting body holes 40–46. The plurality of mounting nuts and bolts 48–54 secure the bracket to a splash tray 82, illustrated in FIG. 3.

A linkage rod 56 including ball joint housings 58 and 60 and threaded ball joints 62 and 64, including nut and lock washers 65 and 66 and 68 and 70 secure to linkage rod 56 accordingly, as illustrated in the figure. The ball joint 64 secures into the body hole 72 of the pedal bar 16. Nuts and washer assemblies 74, 76, 78, and 80 along with flat head machine screws 20, 22, 24, and 26 secure the pedal bar 16 accordingly, as illustrated in FIG. 2, to the foot pedal 12.

FIG. 2 illustrates a side view of FIG. 1 where all numerals correspond to those elements previously described. Particularly illustrated is the two-bar linkage of pedal bar 16 and the linkage rod 56.

MODE OF OPERATION

Figure 3:
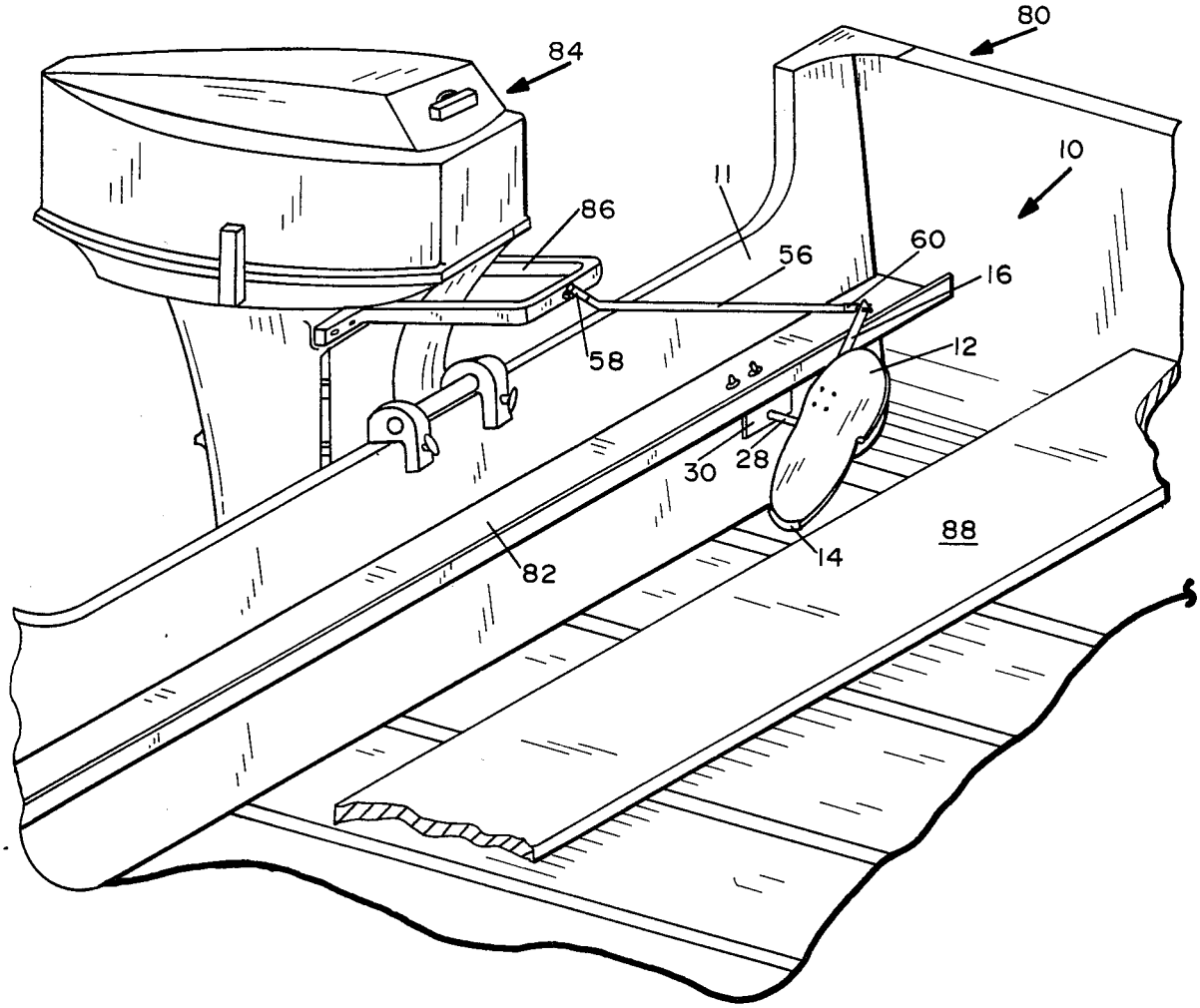
FIG. 3 illustrates the outboard motor steering control system installed in a fishing boat with a splash tray and affixed to an outboard motor with a U-shaped bracket.

FIG. 3 illustrates the outboard motor control steering system 10 in a boat 80 including a splash tray 82, an outboard motor 84 secured thereto with a U-shaped bracket 86, which is standard to outboard motors. The linkage bar 56 connects accordingly thereto. The boat 80, in this particular example, can be a fishing row boat, such as a Lund or the like. The motor 84 can be a Mercury, Mariner, or the like, as all motors have some type of a U-shaped bracket for hand holding. The linkage bar 56 secures thereto and is pivoted by the two-bar linkage of the linkage rod 56 and the pedal bar 16, which secures to the foot pedal 12 and is axially supported by the mounting bracket 30 which is U-shaped. A seat 88 accommodates the fisherman so that the left foot is supported on the foot pedal 12, and the right foot is supported on the other side of the seat 88. The torsion bar and U-shaped bracket can be structured accordingly to accommodate other types of rowboats.

I claim:

1. Motor control steeing system for an outboard motor of a boat comprising:

a. two-bar linkage means including a shorter rigid bar and a longer rigid bar;

b. foot pedal means shaped as a foot and including a heel plate connected to one end of said shorter bar of said two-bar linkage means;

c. outboard motor means connected by a ball joint means to an other end of said longer bar of said two-bar linkage means; and, d. U-shaped bracket means including an axially mounted rod in legs of said bracket means, said rod connected to said foot pedal means and said bracket means including a plurality of holes for receiving bolts, whereby said bracket means bolts to a rear seat of a boat and actuation of said foot pedal means causes rotation within said U-shaped bracket means and transfers motion through said two-bar linkage means to said outboard motor means causing subsequent rotation of said outboard motor means mounted on an end of a boat means and about a vertical axis of said outboard motor means by movement of an individual's foot.

* * * * *